US011028563B2

(12) United States Patent
Nagaiwa et al.

(10) Patent No.: US 11,028,563 B2
(45) Date of Patent: Jun. 8, 2021

(54) WATER FAUCET HOUSING

(71) Applicant: TOTO LTD., Kitakyushu (JP)

(72) Inventors: Hiroyuki Nagaiwa, Kitakyushu (JP); Ryoichi Sugimoto, Kitakyushu (JP); Daisuke Kazaoka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 154 days.

(21) Appl. No.: 15/814,220

(22) Filed: Nov. 15, 2017

(65) Prior Publication Data

US 2018/0135280 A1 May 17, 2018

(30) Foreign Application Priority Data

Nov. 16, 2016 (JP) ..... JP2016-223094

(51) Int. Cl.
*E03C 1/04* (2006.01)
*E03C 1/05* (2006.01)

(52) U.S. Cl.
CPC ..... *E03C 1/0404* (2013.01); *E03C 1/057* (2013.01)

(58) Field of Classification Search
None
See application file for complete search history.

(56) References Cited

U.S. PATENT DOCUMENTS 3,448,768 A * 6/1969 Keller ..... F16K 19/006 118/621
4,356,574 A * 11/1982 Johnson ..... F16K 7/066 137/606
5,131,428 A * 7/1992 Bory ..... E03C 1/0403 137/606
5,746,244 A 5/1998 Woolley, Sr. et al.
6,082,407 A * 7/2000 Paterson ..... E03C 1/04 137/801

(Continued)

FOREIGN PATENT DOCUMENTS

CN 1190169 A 8/1998
EP 3067474 A1 * 9/2016 ..... E03C 1/0404

(Continued)

OTHER PUBLICATIONS

Chinese Office Action issued in Chinese Patent Application No. 201710976211.2 dated Feb. 28, 2019.

(Continued)

*Primary Examiner* — Daphne M Barry
(74) *Attorney, Agent, or Firm* — BakerHostetler

(57) ABSTRACT

Provided is a water faucet capable of ensuring a required strength even when an exterior of the water faucet is formed with a cross-sectional shape having a longer direction and a shorter direction in a cross-section. The water faucet (1) comprises: an exterior member (4) having a longer direction ($L_1$) in a cross-section and a shorter direction ($W_1$) in the cross-section, and forming an exterior of the water faucet (1); a discharging port (34) for discharging water therefrom; a water-conducting member (8) for providing fluid communication between the discharging port (34) and a water supply source for supplying water to the discharging port (34); and a reinforcement member (10) provided inside the exterior member (4) so as to reinforce the exterior member (4).

10 Claims, 4 Drawing Sheets

(56) References Cited

U.S. PATENT DOCUMENTS

| | | | | |
|---|---|---|---|---|
| 7,003,818 | B2 * | 2/2006 | McNerney | E03C 1/0401 4/675 |
| 7,269,864 | B2 * | 9/2007 | Brown | E03C 1/0401 4/678 |
| 7,766,043 | B2 * | 8/2010 | Thomas | E03C 1/04 137/801 |

FOREIGN PATENT DOCUMENTS

| | | | |
|---|---|---|---|
| JP | 3-83270 | U | 8/1991 |
| JP | 2001303631 | A | 10/2001 |

OTHER PUBLICATIONS

Office Action issued in Japanese Application No. 2016-223094, dated Aug. 27, 2020 [with machine-generated translation].

* cited by examiner

WATER FAUCET HOUSING

TECHNICAL FIELD

The present invention relates to a water faucet and more specifically to a water faucet whose exterior has a longer direction in a cross-section and a shorter direction in the cross-section.

BACKGROUND ART

Heretofore, there has been one type of water faucet having a structure as described, for example, in the following Patent Document 1. In the water faucet described in the Patent Document 1, a spout is formed in a circular shape in a cross-section, and a reinforcement member is provided inside the spout so as to reinforce the spout as the spout is made of a synthetic resin.

CITATION LIST

Patent Document

Patent Document 1: JP 2013-087600 A

SUMMARY OF INVENTION

Technical Problem

The shape of a spout of a water faucet gives a large influence to exterior quality of the water faucet, and determines whether a design of the water faucet is good or not. In recent years, in addition to commonly-seen spouts with a circular cross-sectional shape, a spout formed in a flat shape having a longer direction in a cross-section and a shorter direction in the cross-section, such as a rectangular cross-sectional shape and a elliptical cross-sectional shape, has been developed. In this type of water faucet, there is a problem peculiar to the spout with a flat cross-sectional shape, i.e., that a force applied along the shorter direction in the cross-section is more likely to cause deformation of the spout and thus cause damage to the spout. On the other hand, when the shape of a spout is designed so as to ensure a required strength of the spout, some restrictions are imposed on the shape of the spout, leading to difficulty in designing a thinner-type water faucet in various designs.

It is an object of the present invention to provide a water faucet capable of ensuring a required strength even when an exterior of the water faucet is formed with a cross-sectional shape having a longer direction in a cross-section and a shorter direction in the cross-section.

Solution to Technical Problem

In order to achieve the above object, the present invention provides a water faucet which comprises: an exterior member having a longer direction in a cross-section and a shorter direction in the cross-section and forming an exterior of the water faucet; a water-discharge port for discharging water therefrom; a water-conducting member for providing fluid communication between the water-discharge port and a water supply source for supplying water to the water-discharge port; and a reinforcement member provided inside the exterior member so as to reinforce the exterior member.

In the water faucet of the present invention having the above feature, the reinforcement member is provided inside the exterior member. Further, the exterior member is formed in a shape having a longer direction in the cross-section and a shorter direction in the cross-section. Thus, even if a water faucet does not comprise a conventional circular cross-section but comprises an exterior member formed in a shape having a longer direction in a cross-section and a shorter direction in the cross-section, a required strength of the exterior member can be ensured. Thus, for example, even when a force is applied to the exterior member along the shorter direction in the cross-section thereof, deformation and damage can be prevented. In addition, as the reinforcement member is provided inside the exterior member, the required strength of the exterior member can be ensured by the reinforcement member. Thus, flexibility in designing the shape of the exterior member increases. This makes it possible to design various water faucets.

Preferably, in the water faucet of the present invention, the reinforcement member comprises a reinforcement rib extending in a direction orthogonal to the cross-section of the exterior member and in the shorter direction in the cross-section.

According to this feature, the reinforcement member comprises the reinforcement rib, the reinforcing rib extends in the direction orthogonal to the cross-section of the exterior member and also extends in the shorter direction in the cross-section. The exterior member having the longer direction in the cross-section and the shorter direction in the cross-section is likely to be deformed when a force is applied thereto along the shorter direction in the cross-section. In this embodiment, as the reinforcing rib extends in the direction orthogonal to the cross-section of the exterior member and in the shorter direction in the cross-section, bending rigidity of the exterior member in the shorter direction in the cross-section thereof increases. Thus, the exterior member can be effectively reinforced.

Preferably, in the above water faucet, the reinforcement rib is composed of a plate piece cut to a given shape corresponding to a final shape of the reinforcement rib.

According to this feature, as the reinforcement rib is composed of a cut plate piece, so that the reinforcement rib can be formed by cutting a plate which is relatively easily available to a given shape. Thus, the reinforcement rib can be prepared relatively inexpensively and easily. In addition, as the plate piece is cut to a given shape corresponding to the final shape, additional processing such as bending is not necessary. Thus, it facilitates production of the reinforcement rib.

Preferably, in the above water faucet, the reinforcement rib is composed of a laminate of a plurality of the plate pieces.

According to this feature, as the reinforcement rib is composed of a laminate of a plurality of the plate pieces, the reinforcement rib can be formed relatively inexpensively and easily by laminating plate pieces which are relatively easily available. In addition, as the reinforcement rib is formed by laminating the plate pieces, the reinforcement rib can be easily formed in various shapes by increasing/reducing the number of the plate pieces to be laminated, or changing a cut shape of the plate pieces. Further, by varying the size of each of the plurality of plate pieces for example by gradually increasing its size and then laminating them, a shape corresponding to a curved line or a curved surface as a whole can be formed. Therefore, the reinforcement rib can be formed according to an internal shape of the exterior member, thus it facilitates forming of the reinforcement rib according to various shapes.

Preferably, in the above water faucet, each of the plurality of plate pieces has the same thickness. According to this feature, as each of the plurality of plate pieces has the same thickness, the plurality of plate pieces can be produced by cutting the same plate. Thus, production of the reinforcement rib can be facilitated. In addition, as the necessary type of plate pieces in terms of thickness is only one, it is possible to simplify management of the plate pieces.

Preferably, in the above water faucet, each of the plate pieces of the reinforcement rib has a longer direction in a cross-section and a shorter direction in the cross-section, wherein the reinforcement rib is disposed such that the longer direction in the cross-section of each of the plate pieces extends along the shorter direction in the cross-section of the exterior member, and the shorter direction in the cross-section of each of the plate pieces extends along the longer direction in the cross-section of the exterior member, and wherein the plate pieces are laminated along the longer direction in the cross-section of the exterior member.

According to this feature, the reinforcement rib is disposed such that the longer direction in the cross-section of each of the plate pieces extends along the shorter direction in the cross-section of the exterior member, and the shorter direction in the cross-section of each of the plate pieces extends along the longer direction in the cross-section of the exterior member, and the plate pieces are laminated along the longer direction in the cross-section of the exterior member. Therefore, bending rigidity of the exterior member in the shorter direction in the cross-section thereof can be increased and thereby the exterior member becomes less likely to be bent in the shorter direction in the cross-section thereof. Thus, the exterior member can be effectively reinforced. Therefore, even when a force is applied to the exterior member along the shorter direction in the cross-section thereof, the exterior member becomes less likely to be deformed, thus damage to the exterior member can be prevented.

Preferably, in the water faucet of the present invention, the reinforcement member comprises a plurality of reinforcement ribs each extending in a direction orthogonal to a cross-section of the exterior member and in the shorter direction in the cross-section, and the water-conducting member is disposed between respective ones of the plurality of reinforcement ribs.

According to this feature, as the water-conducting member is disposed between respective ones of the plurality of reinforcement ribs, the exterior member can be effectively reinforced around the water-conducting member. In addition, as the reinforcement member comprises a plurality of reinforcement ribs, even when a dimension of each of the reinforcement ribs in the short direction in the cross-section of the exterior member is set to be relatively short, the required strength of the exterior member as a whole can be ensured. This makes it possible to further reduce a dimension of the exterior member in the shorter direction in the cross-section thereof so as to design a thinner-type water faucet.

Preferably, in the above water faucet, the water-conducting member is composed of a plurality of water-conducting pipes.

According to this feature, as the water-conducting member is composed of a plurality of water-conducting pipes, a cross-sectional area of each of the water-conducting pipes can be reduced with respect to a required flow rate of water. Thus, it becomes possible to further reduce the dimension of the exterior member in the shorter direction in the cross-section thereof so as to design a thinner-type water faucet.

Preferably, in the water faucet of the present invention, the exterior member comprises a proximal section connectable to a mounting surface to which the water faucet is to be mounted, a distal section provided with the water-discharge port, and a bent section provided between the proximal section and the distal section, wherein a ratio of a cross-sectional area of the reinforcement member to a cross-sectional area of the exterior member in a cross-section of the exterior member is set such that the ratio at the distal section is smaller than the ratio at the bent section.

According to this feature, a ratio of a cross-sectional area of the reinforcement member to a cross-sectional area of the exterior member, in a cross-section of the exterior member, is set such that the ratio at the distal section is small than the ratio at the bent section. It is often the case that a force is applied to the distal section of the exterior member along the shorter direction in the cross-section of the exterior member. In this situation, in the exterior member, a large moment is generated at the bent section, whereas a relatively small moment is generated at the distal section. Thus, in this embodiment, the ratio of the cross-sectional area of the reinforcement member to the cross-sectional area of the exterior member, in the cross-section of the exterior member, is set such that the ratio is smaller in the distal section than in the bent section, so that the exterior member can be effectively reinforced. In addition, by setting the ratio in the above manner, the cross-sectional area of the reinforcement member in the distal section is relatively reduced. Therefore, larger space within the exterior member in the distal section so that various internal mechanisms of the water faucet can be provided therein.

Preferably, in the water faucet of the present invention, the exterior member comprises a first cover having a first surface extending in the longer direction in the cross-section thereof, and a second cover having a second surface extending in the longer direction in the cross-section thereof and facing to and attached to the first cover.

According to this feature, as the exterior member comprises the first cover and the second cover, the exterior member can be formed by assembling the first cover and the second cover together. Therefore, assembling and production of the exterior member is facilitated. In addition, as the exterior member comprises the first cover and the second cover, the reinforcement member can be easily disposed inside the exterior member, for example, by disposing the reinforcement member between the first cover and the second cover, and then attaching the first and second covers to each other.

DESCRIPTION OF EMBODIMENTS

With reference to the accompanying drawings, the present invention will now be described based on a preferred embodiment thereof.

Figure 1:
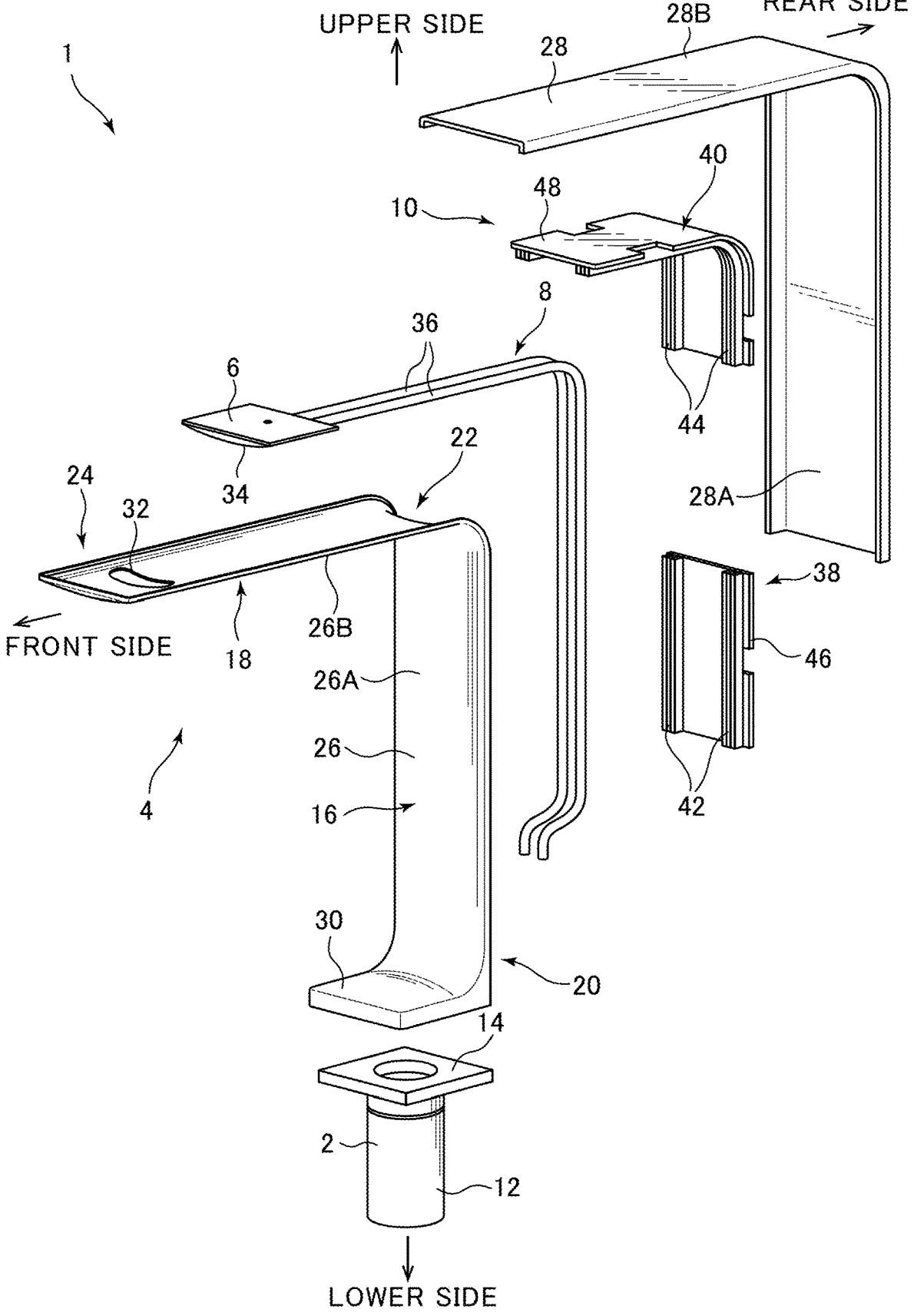
FIG. 1 is an exploded perspective view of a water faucet according to one embodiment of the present invention.
Figure 2:
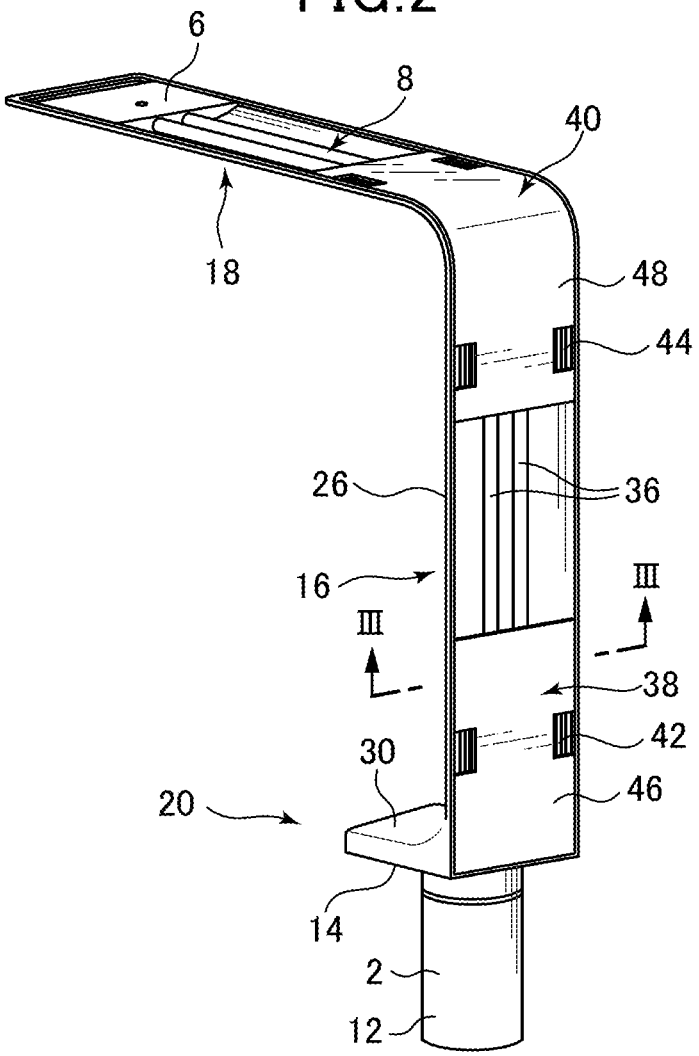
FIG. 2 is a perspective view of the water faucet according to this embodiment, in a state after a second cover is removed therefrom.

FIG. 1 is an exploded perspective view of a water faucet according to one embodiment of the present invention, and FIG. 2 is a perspective view of the water faucet according to the one embodiment, in a state after an aftermentioned second cover is removed therefrom. As depicted in FIGS. 1 and 2, the water faucet 1 according to this embodiment comprises: an attachment segment 2 attachable to a mounting surface (not depicted) to which the water faucet 1 is to be mounted; an exterior member 4 fixed to the attachment segment 2 and forming an exterior of the water faucet 1; a water-discharging segment 6 for discharging water therefrom; a water-conducting member 8 for providing fluid communication between a water supply source (not depicted) for supplying water to the water faucet 1 and the water-discharging segment 6; and a reinforcement member 10 disposed inside the exterior member 4 and reinforcing the exterior member 4. This embodiment will be described on an assumption that the mounting surface is a horizontal surface, therefore, an upper side and a lower side in FIGS. 1 and 2 are respectively described as an upper side of the water faucet 1 and a lower side of the water faucet 1. Further, this embodiment will be described on an assumption that a side toward which a distal side of the exterior member 4 protrudes (in FIGS. 1 and 2, a leftward and obliquely-forward direction) is described as a front side of the water faucet 1, and an opposite side thereof (in FIGS. 1 and 2, a rightward and obliquely-backward direction) as a rear side of the water faucet 1. However, the mounting surface is not limited to a horizontal surface, but may be set in an arbitrary direction, e.g., may be a vertical wall surface.

The attachment segment 2 comprises a water supply pipe 12 connectable to the water supply source, and a base plate 14 fixed to an end of the water supply pipe 12. The base plate 14 is formed of an substantially rectangular plate-like member, and disposed such that a surface thereof extends in a direction substantially orthogonal to an axial direction of the water supply pipe 12.

The exterior member 4 is a member formed in a generally approximately L shape, which comprises a first spout portion 16 attached to the attachment segment 2 to extend in a direction parallel to the axial direction of the water supply pipe 12, i.e., in an upward-downward direction, and a second spout portion 18 bent approximately at a right angle with respect to the first spout portion 16 to extend in a forward-rearward direction. The exterior member 4 has a proximal section 20 located on the side of the attachment segment 2 on the first spout portion 16, a bent section 22 between the first spout portion 16 and the second spout portion 18, and a distal section 24 located on a side away from the bent section 22 on the second spout portion 18.

The exterior member 4 is formed of a first cover 26, and a second cover 28 attachable as opposed to the first cover 26. The first cover 26 has a front surface portion 26A forming a front surface of the first spout portion 16, and a lower surface portion 26B forming a lower surface of the second spout portion 18. The second cover 28 has a rear surface portion 28A forming a rear surface of the first spout portion 16, and an upper surface portion 28B forming an upper surface of the second spout portion 18.

The first cover 26 has an approximately rectangular-shaped cover portion 30 covering an upper surface of the base plate 14 of the attachment segment 2 at its proximal end (lower end). Among four sides of an outer edge of the cover portion 30, three sides are fixed to an outer edge of the base plate 14 by welding or the like. The front surface portion 26A is integrally formed at the outer edge (specifically, a rear side) of the cover portion 30 which is not fixed to the base plate 14. Further, the lower surface portion 26B is integrally formed at an upper end of the front surface portion 26A. The lower surface portion 26B extends forwardly in the horizontal direction. The first cover 26 has an opening 32 at a distal region thereof to allow water discharged from the water-discharging segment 6 to pass therethrough.

The second cover 28 is fixed to the outer edge of a rear side of the base plate 14 of the attachment segment 2 at its proximal end (lower end) by welding or the like. The rear surface portion 28A of the second cover 28 extends in the upward-downward direction, and the upper surface portion 28B is integrally formed at an upper end of the rear surface portion 28A. The upper surface portion 28B extends forwardly in the horizontal direction.

The first cover 26 and the second cover 28 are configured in the above manner. Thus, the the first spout portion 16 extends vertically, i.e., in a direction parallel to the axial direction of the water supply pipe 12 of the attachment segment 2, at a position offset rearwardly with respect to the axis of the water supply pipe 12 of the attachment segment 2. Further, the second spout portion 18 extends horizontally forwardly from an upper end of the first spout portion 16. Then, the first cover 26 and the second cover 28 are assembled such that respective outer edges thereof are fixed together by welding or the like, so that they are formed as a hollow exterior member 4.

Figure 3:
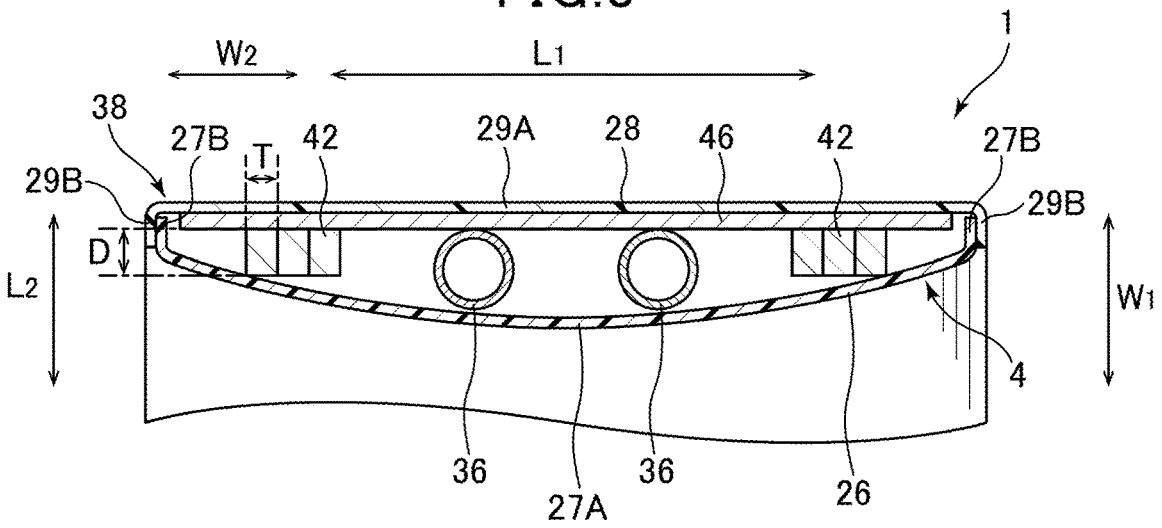
FIG. 3 is a sectional view taken along the line in FIG. 2.

FIG. 3 is a sectional view taken along the line in FIG. 2. As depicted in FIG. 3, by assembling the first cover 26 and the second cover 28 together, the exterior member 4 has a flat cross-sectional shape having a longer direction $L_1$ in the cross-section and a shorter direction Wi in the cross-section.

More specifically, as depicted in FIG. 3, the first cover 26 has a curved surface portion 27A curved in a direction away from a surface of the second cover 28 in a central region thereof in the longer direction $L_1$ in the cross-section, and rising portions 27B protruding (rising) from either sides of the curved surface portion 27A toward the second cover 28. The curved surface portion 27A generally extends along the longer direction $L_1$ in the cross-section, although it is curved.

As depicted in FIG. 3, the second cover 28 has a planar surface portion 29A extending linearly along the longer direction $L_1$ in the ross-section, and arising portions 29B protruding (rising) from either sides of the planar surface portion 29A toward the first cover 26.

The first cover 26 and the second cover 28 are fixed together by welding or the like in a state in which the rising portions 27B, 28B are superposed on each other, so that they are assembled together in opposed relation to each other.

The water-discharging segment 6 has a cross-sectional shape according to a cross-sectional shape of the exterior member 4, and provided inside the exterior member 4. More specifically, the water-discharging segment 6 has: an upper surface formed as a substantially rectangular-shaped planar surface corresponding to the planar surface portion 29A of the second cover 28; and a lower surface formed as a curved surface whose central region along the longer direction $L_1$ in the cross-section is curved downwardly in an arc shape, which corresponds to the curved surface portion 27A of the first cover 26. The water-discharging segment 6 has a discharge port 34 formed on the lower surface thereof to discharge water to the outside through the opening 32 of the first cover 26.

The water-conducting member 8 is composed of a plurality of (in this embodiment, two) water-conducting pipes 36. These water-conducting pipes 36 are arranged parallel and spaced apart at a predetermined interval to each other to extend along the shape of the exterior member 4. More specifically, each of the water-conducting pipes 36 connects to and communicates with the water supply pipe 12 of the attachment segment 2 at its proximal side; extends inside the first spout portion 16 to the bent section 22 in the upward-downward direction; in the bent section 22, is bent substantially at a right angle in conformity to the shape of the bent section 22 at the bent section 22; and extends inside the second spout portion 18 horizontally and forwardly from the bent section 22 to the distal section 24 of the second spout portion 18. The water-conducting pipe 36 connects to and communicates with the water-discharging segment 6 at its distal side.

Although not depicted, a sensor capable of detecting a user's hand is provided near the water-discharging segment 6, and signal lines for transmitting a signal from the sensor to a supply value of the water supply pipe 12 are disposed along the water-conducting pipes 36.

The reinforcement member 10 comprises a first reinforcement member 38 provided at the proximal section 20 of the first spout portion 16, and a second reinforcement member 40 provided at the bent section 22. Each of the first and second reinforcement members 38, 40 comprises reinforcement ribs 42, 44 reinforcing the exterior member 4, and holding members 46, 48 holding the reinforcement ribs 42, 44 at a given position.

The reinforcement ribs 42, 44 are formed by cutting plates having the same thickness to a given shape, and laminating a plurality (in this embodiment, three) of the resulting plate pieces.

As depicted in FIGS. 1 and 3, the plate pieces of the reinforcement rib 42 of the first reinforcement member 38 are formed by cutting a plate having a given thickness T to a bar-like shape having a given same width D. In this case, the plate is cut to a length equal to a longitudinal dimension (i.e., a dimension in the upward-downward direction) of the holding member 46. Since the shape of each of the cut plate pieces is identical to a final shape of the reinforcement rib 42 when it is incorporated in the exterior member 4 except for the thickness of the plate pieces of the reinforcement rib 42, the plate pieces are not subjected to a further process such as bending.

In this embodiment, the given width D is set to be greater than the thickness T. Thus, each of the plate pieces of the reinforcement rib 42 has a substantially rectangular cross-sectional shape having a longer direction $L_2$ in the cross-section (a direction along the given width D) and a shorter direction $W_2$ in the cross-section (a direction along the thickness T).

The reinforcement rib 42 is disposed such that the direction along the thickness T of the plate pieces extends along the longer direction $L_1$ in the cross-section of the exterior member 4, and the direction along the given width D of the plate pieces extends along the short direction $W_1$ in the cross-section of the exterior member 4. That is, the reinforcement rib 42 is disposed such that the longer direction $L_2$ in the cross-section of the plate pieces extends along the shorter direction $W_1$ in the cross-section of the exterior member 4, and the short direction $W_2$ in the cross-section of the plate pieces extends along the longer direction $L_1$ in the cross-section of the exterior member 4. Further, the plurality of plate pieces of the reinforcement rib 42 are laminated along the longer direction $L_1$ in the cross-section of the exterior member 4.

A pair of the reinforcement ribs 42 each formed by lamination of the plurality of plate pieces in the above manner are respectively arranged on either sides of the the water-conducting pipes 36 with respect to the longer direction $L_1$ in the cross-section of the exterior member 4. Therefore, in the cross-section of the water faucet 1 as depicted in FIG. 3, the two water-conducting pipes 36 are arranged between the pair of reinforcement ribs 42. The reinforcement ribs 42 are disposed to extend along a longitudinal direction of the exterior member 4, i.e., a direction orthogonal to the cross-section of the exterior member 4, and extend parallel to a longitudinal direction of the water-conducting pipes 36.

Although not depicted, each of the reinforcement ribs 44 of the second reinforcement member 40 is formed, similarly to the reinforcement ribs 42, by laminating a plurality (in this embodiment three) of plate pieces each having the same thickness as that of the plate pieces of the reinforcement rib 42 of the first reinforcement member 38. More specifically, each of the plate pieces of the reinforcement rib 44 is formed by cutting a plate having a thickness T to a substantially L shape having a given width D. In this case, the plate is cut to a length equal to a dimension along a longitudinal direction of a surface of the holding member 48, i.e., a sum of a dimension along the upward-downward direction of a portion of the holding member 48 extending in the upward-downward direction, a length of an arc-shaped portion of the holding member 48 corresponding to the bent section 22, and a dimension along the forward-rearward direction of a portion of the holding member 48 extending in the horizontal direction. Since the shape of each of the plate pieces cut in the above manner is a substantially L shape which is identical to a final shape of the reinforcement rib 44 when it is incorporated in the exterior member 4 except for the thickness of the plate pieces of the reinforcement rib 44, the plate pieces are not subjected to a further processing such as bending.

In this embodiment, the given width D is set to be greater than the thickness T. Thus, each of the plate pieces of the reinforcement rib 44 has a substantially rectangular cross-sectional shape having a longer direction in the cross-section (a direction along the given width D) and a shorter direction in the cross-section (a direction along the thickness T). That is, the reinforcement rib 44 is disposed such that the longer direction in the cross-section of each of the plate pieces extends along the shorter direction $W_1$ in the cross-section of the exterior member 4, and the shorter direction in the cross-section of each of the plate pieces extends along the longer direction $L_1$ in the cross-section of the exterior member 4. Further, the plate pieces are laminated along the longer direction $L_1$ in the cross-section of the exterior member 4.

A pair of the reinforcement ribs 44, similar to the reinforcement ribs 42, are respectively arranged on either sides of the the water-conducting pipes 36 with respect to the longer direction $L_1$ in the cross-section of the exterior member 4. Therefore, in the cross-section of the water faucet 1, the two water-conducting pipes 36 are arranged between the pair of reinforcement ribs 44. Each of the reinforcement ribs 44 is disposed to extend along the longitudinal direction of the exterior member 4, i.e., the direction orthogonal to the cross-section of the exterior member 4, and extend parallel to the longitudinal direction of the water-conducting pipes 36.

Each of the holding members 46, 48 is formed of a plate-like member having a width corresponding to a dimension of an internal space of the exterior member 4 in the longer direction $L_1$ in the cross-section. The holding member 46 of the first reinforcement member 38 is formed in a substantially rectangular plate-like shape, and disposed such that a longitudinal direction thereof extends along the upward-downward direction. The holding member 46 is disposed on the side of the second cover 28 among the first and second covers 26, 28. More specifically, the holding member 46 is disposed rearward of the first cover 26 and the water-conducting pipes 36, and forward of the second cover 28. In other words, the holding member 46 is disposed between the water-conducting pipes 36 and the second cover 28. The reinforcement ribs 42 are fixed to a front surface of the holding member 46 by welding or the like. Thus, each of the reinforcement ribs 42 extends to protrude forwardly from the front surface of the holding member 46.

The holding member 48 of the second reinforcement member 40 is formed as a plate-like member which is bent to a substantially L shape, and disposed such that a bent portion of the holding member 48 corresponds to the bent section 22 of the exterior member 4. As with the holding member 46, the holding member 48 is disposed on the side of the second cover 28 among the first and second covers 26, 28. More specifically, a portion of the holding member 48 located on the first spout portion 16 is disposed rearward of the first cover 26 and the water-conducting pipes 36, and a portion of the holding member 48 located on the second spout portion 18 is disposed upward of the first cover 26 and the water-conducting pipes 36. That is, the holding member 48 is disposed between the water-conducting pipes 36 and the second cover 28.

The reinforcement ribs 44 in the laminated state are fixed to a surface of the front side of the holding member 48 located in the first spout portion 16 by welding or the like. Thus, the reinforcement ribs 44 extend to protrude forwardly from the surface of the front side of the holding member 48. Further, the reinforcement ribs 44 in the laminated state are fixed to a surface of a lower side of the region of the holding member 48 located in the second spout portion 18 by welding or the like. Thus, each the reinforcement ribs 44 extend to protrude downwardly from the surface of the lower side of the holding member 48.

In this embodiment, the laminated plate pieces in each of the reinforcement ribs 42, 44 are not fixed to teach other, but welded and fixed to a corresponding one of the holding members 46, 48 in a state contacting with the adjacent plate piece. However, the plurality of plate pieces composing each of the reinforcement ribs 42, 44 may be fixed to each other by bonding, welding or the like.

In the first and second reinforcement members 38, 40, the reinforcement ribs 44 are provided in the bent section 22. However, no reinforcement rib is provided in the distal section 24. Thus, with respect to a ratio of a cross-sectional area of the reinforcement ribs to a cross-sectional area of the exterior member 4 in the cross-section of the exterior member 4, the ratio in the distal section 24 is smaller than the ratio in the bent section 22.

In the water faucet according to this embodiment configured as above, when the sensor provided around the water-discharging segment 6 detects that a hand is inserted beneath the water-discharging segment 6, a detection signal is transmitted from the sensor to the supply value via the signal lines, thereby opening the supply valve. Water from the water supply source is divided into two streams through the two water-conducting pipes 36, respectively, the two streams are merged at the water-discharging segment 6 and discharged from the discharging port 34.

The water faucet according to this embodiment configured as above can obtain the following excellent advantageous effects.

The exterior member 4 is formed in a flat cross-sectional shape having a longer direction $L_1$ in the cross-section and a shorter direction $W_1$ in the cross-section, and the reinforcement member 10 is provided inside the exterior member 4. Thus, not only in a water faucet having a conventional circular cross-sectional shape but also in a water faucet comprising an exterior member formed in a flat and thin shape having a longer direction in the cross-section and a shorter direction in the cross-section, a required strength of the exterior member can be ensured. Thus, for example, when a user pushes the second spout portion 18 of the water faucet 1 downwardly from above the second spout portion 18, deformation and damage in the bent section 22 or the proximal section 20 can be prevented.

As the reinforcement member 10 is provided inside the exterior member 4, the required strength of the exterior member 4 can be ensured without giving a negative influence to the appearance of the exterior member 4. Thus, when designing the exterior member 4, aesthetic quality of the exterior member 4 can be prioritized, therefore various designs of the water faucets 1 become feasible.

As the reinforcement ribs 42, 44 of the reinforcement member 10 extend in a direction orthogonal to the cross-section of the exterior member 4 and also extend in the shorter direction $W_1$ in the cross-section, bending rigidity of the exterior member 4 in the shorter direction $W_1$ in the cross-section can be increased. Thus, the exterior member 4 can be effectively reinforced.

As the reinforcement ribs 42, 44 are formed by cutting a plate to a given shape, the reinforcement ribs 42, 44 can be formed using a plate which is relatively easily available. Thus, the preparation of the reinforcement ribs 42, 44 becomes relatively inexpensive and easy. In addition, as the plate piece is cut directly to a shape corresponding to the final shape of the reinforcement ribs 42, 44, additional processing such as bending is not necessary. Thus, production of the reinforcement ribs 42, 44 becomes easy.

As the reinforcement ribs 42, 44 are composed of a laminate of the plurality of plate pieces, plate pieces which are relatively easily available can be used to laminate and form the reinforcement ribs 42, 44 with a desired thickness. Thus, forming of the reinforcement ribs in various shapes becomes relatively inexpensive and easy. In addition, as the reinforcement ribs 42, 44 are formed by laminating the plurality of plate pieces, the reinforcement ribs 42, 44 can be formed in various shapes by increasing/reducing the number of the plate pieces to be laminated, or changing a cut shape of the plate pieces to a bar-like shape or a substantially L shape.

As each of the plate pieces forming the reinforcement ribs 42, 44 has the same thickness T, in production of the reinforcement ribs 42, 44, it is only necessary to cut the same plate to a given shape. Thus, production process of the reinforcement ribs 42, 44 can be simplified. In addition, as only one type of plate pieces is required, management of the plate pieces can be simplified.

The reinforcement ribs 42, 44 are disposed such that the longer direction $L_2$ in the cross-section of each of the plate pieces extends along the shorter direction $W_1$ in the cross-section of the exterior member 4, and the shorter direction $W_2$ in the cross-section of each of the plate pieces extends along the longer direction $L_1$ in the cross-section of the exterior member 4. Therefore, bending rigidity of the exterior member 4 in the shorter direction $W_1$ in the cross-section can be increased and thus the exterior member 4 becomes less likely to be bent in the shorter direction $W_1$ in the cross-section. Thus, the exterior member 4 can be effectively reinforced. Therefore, even when a force is applied to the exterior member 4 in the shorter direction $W_1$ in the cross-section, deformation and damage of the exterior member 4 can be prevented.

As the water-conducting pipes 36 are disposed between the plurality of (two) reinforcement ribs 42, 44, the exterior member 4 can be effectively reinforced around the water-conducting pipes 36. Further, as the plurality of the reinforcement ribs 42, 44 are provided, a required strength as a whole can be ensured compared to a case where only one reinforcement rib is provided as each of the reinforcement ribs 42, 44 even if the dimension in the shorter direction $W_2$ in the cross-section becomes smaller. Therefore, it is possible to further reduce a dimension of the exterior member 4 in the shorter direction $W_1$ in the cross-section to provide thinner water faucet 1.

Further, as the plurality of the water-conducting pipes 36 is provided, a cross-sectional area of each of the water-conducting pipes 36 required for ensuring a given flow rate of water can be reduced. This makes it possible to further reduce the dimension of the exterior member 4 in the shorter direction $W_1$ in the cross-section to design the water faucet 1 to be thinner while ensuring a required flow rate of water.

In the cross-section of the exterior member 4, the ratio of the cross-sectional area of the reinforcement ribs 44 to the cross-sectional area of the exterior member is set such that it becomes smaller in the distal end-side section 24 than in the bent section 22. When a force is applied to the second spout portion 18 of the exterior member 4 along the shorter direction $W_1$ in the cross-section, in the exterior member 4, a relatively large moment is generated in the bent section 22 whereas a relatively small moment is generated in the distal end-side section 24. Thus, in this embodiment, as the reinforcement ribs 44 are provided in the bent section 22 and not in the distal section 24, it is possible to efficiently reinforce the exterior member 4. In addition, as no reinforcement rib is provided in the distal section 24, it becomes possible to provide a larger internal space of the exterior member 4 in the distal 24 while ensuring the required strength of the exterior member 4. It enables various internal mechanisms such as a water flow straightening device and a sensor capable of detecting a user's hand to be provided therein.

As the exterior member 4 comprises the first cover 26 and the second cover 28, the exterior member 4 can be easily assembled and produced. In addition, the exterior member 2 comprises the first cover 26 and the second cover 28, so that the reinforcement member 10 can be easily disposed inside the exterior member 4, for example, by: placing the reinforcement member 10 and the water-conducting member 8 on the first cover 26; attaching the second cover 28 to cover the first cover 26 from thereabove; and mutually fixing the first and second covers 26, 28 by welding or the like.

The present invention is not limited to the above embodiment. For example, it may include the following embodiments.

In the above embodiment, by providing the second reinforce member 40 in the bent section 22 while providing no reinforce member in the distal section 24, the ratio of the cross-sectional area of the reinforcement member to the cross-sectional area of the exterior member in the cross-section of the exterior member 4 is set such that the ratio in the distal section 24 is smaller than the ratio in the bent section 22. However, for example, reinforcement members may be provided in both of the bent section 22 and the distal 24, and the ratio of the cross-sectional area of the reinforcement member to the cross-sectional area of the exterior member in the cross-section of the exterior member 4 may be set such that the ratio in the distal 24 is smaller than the ratio in the bent section 22.

Figure 4:
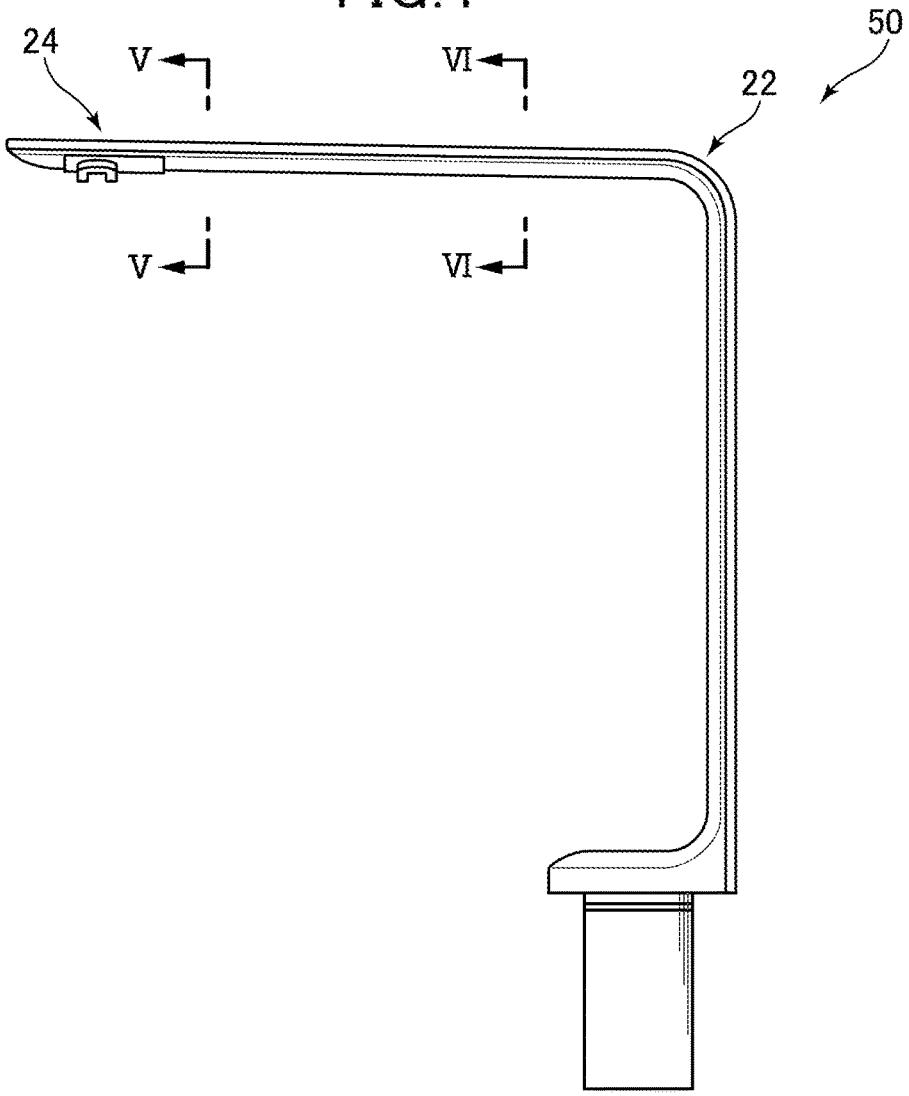
FIG. 4 is a side view of a water faucet according to a modification of the above embodiment.
Figure 5:
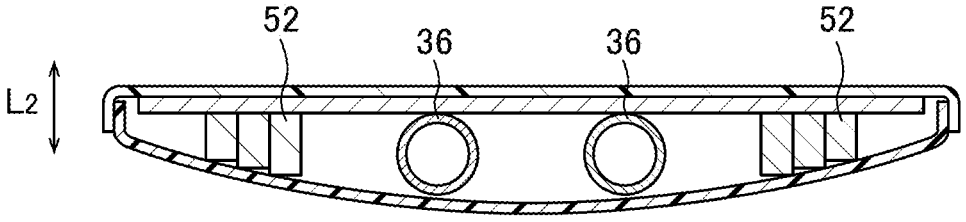
FIG. 5 is a sectional view taken along the line V-V in FIG. 4.
Figure 6:
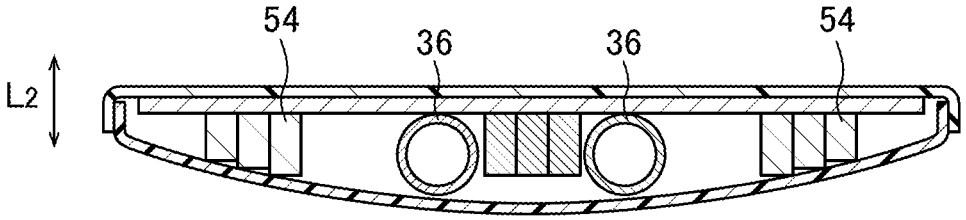
FIG. 6 is a sectional view taken along the line VI-VI in FIG. 4.

FIG. 4 is a side view of a water faucet 50 according to a modification of the above embodiment, and FIG. 5 and FIG. 6 are a sectional view taken along the line V-V in FIG. 4 and a sectional view taken along the line VI-VI in FIG. 4, respectively. As depicted in FIGS. 5 and 6, the water faucet 50 is configured such that two reinforcement ribs 52 are provided in the distal end-side section 24 on either sides of the water-conducting pipes 36, and three reinforcement ribs 54 are provided in the bent section 22 on both sides of the water-conducting pipes 36 and between the water-conducting pipes 36 in the bent section 22.

In this way, by providing less reinforcement ribs 52, 54 in the distal section 24 than in the bent section 22, the ratio of the cross-sectional area of the reinforcement member to the cross-sectional area of the exterior member, in the cross-section of the exterior member 4, may be set such that the ratio in the distal section 24 is smaller than the ratio in the bent section 22. Alternatively, by providing less plate pieces to be laminated of the reinforcement rib in the distal 24 than in the bent section 22, by reducing the thickness of the reinforcement ribs, or by reducing a dimension of the reinforcement rib in at least one of the longer direction and the shorter direction in the cross-section thereof in the distal section 24 than in the bent section 22, the ratio of the cross-sectional area of the reinforcement member to the cross-sectional area of the exterior member in the cross-section of the exterior member 4 may be set such that the ratio in the distal section 24 is smaller than in the bent section 22.

In the above embodiment, the reinforcement ribs 42, 44 are formed with the plurality of plate pieces with the same shape. However, for example, as depicted in FIGS. 5 and 6, the reinforcement ribs 52, 54 may be formed with a plurality of plate pieces having different dimensions to each other in the longer direction $L_2$ in the cross-section. In this case, as depicted in FIG. 5, the dimensions of each of the plate pieces in the reinforcement ribs 52 in the longer direction $L_2$ in the cross-section may be set according to the shape of the internal space of the exterior member 4. Further, as depicted in FIG. 6, each of the plate pieces of the reinforcement ribs 54 on either sides of the water-conducting pipes 36 may be formed in sizes different from each other, and the plate pieces of the reinforcement rib 54 between the water-conducting pipes 36 may be formed in the same size. In this case, each of the reinforcement ribs can be formed in a shape according to the internal shape of the external member. Thus, it becomes possible to easily and reliably reinforce exterior members in various shapes.

In the above embodiment, the reinforcement member is provided in part of the exterior member in the longitudinal detection thereof. However, for example, the reinforcement member may be provided over the entire length of the exterior member in the longitudinal detection thereof.

In the above embodiment, the cross-sectional shape of the exterior member 4 is defined by a planar surface in one surface and a curved surface in the other surface curved in a direction away from the one surface. However, any other cross-sectional shape may be employed according to a desired design, as long as the shape has a longer direction and a shorter direction in the cross-section.

In the above embodiment, the exterior member 4 is formed by the first cover 26 and the second cover 28. However, an assembly structure of the exterior member may be arbitrarily set according to a desired shape or the like.

LIST OF REFERENCE SIGNS

1: water faucet
4: exterior member
6: water-discharging segment 6
8: water-conducting member
26: first cover
27A: curved surface portion (first surface)
28: second cover
29A: planar surface portion (second surface)
10, 38, 40: reinforcement member
34: discharging port
36: water-conducting pipe
42, 44, 52, 54: reinforcement rib
46, 48: holding member

The invention claimed is:

1. A water faucet housing comprising:

an exterior member, a cross-section of which has a longer direction and a shorter direction, a first spout portion extending in an upward-downward direction from a proximal section connection to a mounting surface to which a water faucet is to be mounted, and a second spout portion bent with respect to the first spout portion at an end opposite to the proximal section of the first spout portion to extend in a forward-rearward direction toward a distal section, and forming an exterior of the water faucet housing;

a discharging port for discharging water therefrom positioned at the distal section of the second spout portion;

a water-conducting member for providing fluid communication between the discharging port and a water supply source for supplying water to the discharging port; and a reinforcement member provided inside the first and the second spout portions of the exterior member, the reinforcement member formed separately from the exterior member and the water-conducting member and comprising a plurality of reinforcement ribs each of which extends in a direction orthogonal to the cross-section of the exterior member and in the shorter direction in the cross-section and extends along the first and second spout portions through the bent section between the first spout portion and the second spout portion such that the reinforcement member is connected to the bent section and reinforces the exterior member, wherein the water-conducting member is placed between the reinforcement ribs.

2. The water faucet housing as recited in claim 1, wherein each of the reinforcement members comprises a reinforcement rib extending in a direction orthogonal to the cross-section of the exterior member and in the shorter direction in the cross-section.

3. The water faucet housing as recited in claim 2, wherein the reinforcement rib is composed of a plate piece cut to a given shape corresponding to a final shape of the reinforcement rib.

4. The water faucet housing as recited in claim 3, wherein the reinforcement rib is composed of a laminate of a plurality of the plate pieces.

5. The water faucet housing as recited in claim 4, wherein each of the plurality of plate pieces has a same thickness.

6. The water faucet housing as recited in claim 5, wherein each of the plate pieces of the reinforcement rib has a longer direction and a shorter direction in a cross-section, and wherein the reinforcement rib is disposed such that the longer direction in the cross-section of each of the plate pieces extends along the shorter direction in the cross-section of the exterior member, and the shorter direction in the cross-section of each of the plate pieces extends along the longer direction in the cross-section of the exterior member, and wherein the plate pieces are laminated along the longer direction in the cross-section of the exterior member.

7. The water faucet housing as recited in claim 4, wherein each of the plate pieces of the reinforcement rib has a longer direction and a shorter direction in a cross-section, and wherein the reinforcement rib is disposed such that the longer direction in the cross-section of each of the plate pieces extends along the shorter direction in the cross-section of the exterior member, and the shorter direction in the cross-section of each of the plate pieces extends along the longer direction in the cross-section of the exterior member, and wherein the plate pieces are laminated along the longer direction in the cross-section of the exterior member.

8. The water faucet housing as recited in claim wherein the water-conducting member is composed of a plurality of water-conducting pipes.

9. The water faucet housing as recited in claim 1, wherein ratio of a cross-sectional area of the reinforcement member to a cross-sectional area of the exterior member in the cross-section of the exterior member is set such that the ratio in the distal section is smaller than the ratio in the bent section.

10. The water faucet housing as recited in claim 1, wherein the exterior member comprises a first cover having a first surface extending in the longer direction in the cross-section thereof, and a second cover having a second surface extending in the longer direction in the cross-section thereof and facing to and attached to the first cover.

* * * * *